US005124676A

United States Patent [19]

Ueno

[11] Patent Number: 5,124,676

[45] Date of Patent: Jun. 23, 1992

[54] DIELECTRIC FILTER HAVING VARIABLE RECTANGULAR CROSS SECTION INNER CONDUCTORS

[75] Inventor: Moriaki Ueno, Souma, Japan

[73] Assignee: Alps Electric Co., Ltd., Tokyo, Japan

[21] Appl. No.: 661,759

[22] Filed: Feb. 27, 1991

[30] Foreign Application Priority Data

Mar. 27, 1990 [JP] Japan ..... 2-31419[U]

[51] Int. Cl.[5] ..... H01P 1/202

[52] U.S. Cl. ..... 333/206; 333/222

[58] Field of Search ..... 333/202, 203, 206, 207, 333/222, 219, 219.1

[56] References Cited

U.S. PATENT DOCUMENTS 4,179,673 12/1979 Nishikawa et al. ..... 333/202 X
4,506,241 3/1985 Makimoto et al. ..... 333/222
4,733,208 3/1988 Ishikawa et al. ..... 333/202
4,985,690 1/1991 Eguchi et al. ..... 333/206 X

FOREIGN PATENT DOCUMENTS 0157401 7/1987 Japan ..... 333/202

*Primary Examiner*—Eugene R. LaRoche
*Assistant Examiner*—Seung Ham
*Attorney, Agent, or Firm*—Guy W. Shoup; David W. Heid; B. Noël Kivlin

[57] ABSTRACT

A dielectric filter having a generally box-like dielectric block, an outer conductor covering side surfaces of the dielectric block, a plurality of inner conductors arranged in the dielectric block in the longitudinal direction so as to extend between two opposite faces of the block, and a short-circuit conductor provided in one of the two faces of the dielectric block to connect the outer and inner conductors. At least one of the inner conductors has a rectangular cross-sectional shape, and the size of this sectional shape in the longitudinal direction of the dielectric block is increased at the face where the short-circuit conductor is provided, and is reduced at the other face.

7 Claims, 3 Drawing Sheets

DIELECTRIC FILTER HAVING VARIABLE RECTANGULAR CROSS SECTION INNER CONDUCTORS

BACKGROUND OF THE INVENTION

This invention relates to a dielectric filter for use in various kinds of radiocommunication equipment.

FIG. 3(*a*) is a perspective view of the construction of a conventional dielectric filter. FIG. 3(*b*) is a cross-sectional view taken along the line A—A' of FIG. 3(*a*). FIG. 3(*c*) is a cross-sectional view taken along the line B—B' of FIG. 3(*a*). Referring to FIGS. 3(*a*) to 3(*c*), a generally box-like dielectric body 1 has an open end 1A formed as its one end face, and through holes 2*a*, 2*b*, and 2*c* formed so as to extend from the open end 1A to a short-circuit end 1B provided at the other end face. The length of the through holes 2*a*, 2*b*, and 2*c* is set to approximately ¼ the wavelength λ corresponding to the desired resonance frequency. Each of the through holes 2*a*, 2*b*, and 2*c* has a circular cross-sectional shape and the diameter of each hole is changed at an intermediate position from a smaller diameter on the open end side to a larger diameter on the short-circuit end side. Inner conductors 3*a*, 3*b*, and 3*c* are formed on inner surfaces of the through holes 2*a*, 2*b*, and 2*c*, respectively. An outer conductor 4 is formed over outer surfaces of the dielectric block 1 except for the open end 1A. The inner conductors 3*a*, 3*b*, and 3*c* and the outer conductor 4 are connected at the short-circuit end 1B of the dielectric body 1. The inner conductors 3*a* and 3*c* are connected to input/output terminals Ta and Tc through input/output capacitors Ca and Cc, respectively.

In this type of coupling distribution constant line circuit open at its one end and connected at the other end, coupling in an odd mode is strong at the open end 1A while coupling in an even mode is strong at the short-circuit end 1B. The odd mode coupling is capacitive coupling, and the even mode coupling is inductive coupling. The odd mode coupling and the even mode coupling cancel out each other. Accordingly, if the through holes 2*a*, 2*b*, and 2*c* have a cylindrical shape uniform in diameter, no coupling occurs between the inner conductors 3*a*, 3*b*, and 3*c*. Ordinarily, to obtain desired band-pass characteristics, the shape of the through holes 2*a*, 2*b*, and 2*c* and other factors are determined so that suitable coupling occurs between the inner conductors 3*a*, 3*b*, and 3*c*. In the case of the construction shown in FIGS. 3(*a*) to 3(*c*), the diameter of the through holes 2*a*, 2*b*, and 2*c* is reduced on the open end 1A side to weaken odd mode coupling while the diameter is increased on the short-circuit end 1B side to strengthen even mode coupling. Inductive couplings thereby occur between the inner conductors 3*a*, 3*b*, and 3*c*. The inductive couplings thereby provided attenuate signals having frequencies higher than the desired pass band. Also, the small-diameter portions of the inner conductors 3*a*, 3*b*, and 3*c* function as a small-capacity distribution constant line circuit.

In the conventional dielectric filter described above, the diameter of the inner conductors on the open end side is reduced in order to weaken capacitive coupling between the adjacent inner conductors. For this reason, the distance between the inner and outer conductor is large, and the areas of portions of these conductors facing each other are small, and the capacitances between the inner and outer conductors are small. For desired sharpness of the filter, skirt characteristics, however, a certain capacitance between inner and outer conductors is required. If a large capacitance between inner and outer conductors is required, it is necessary to increase the axial size of the inner conductors in order to achieve that capacitance. It is therefore difficult to reduce the overall size of the dielectric filter.

SUMMARY OF THE INVENTION

The present invention has been achieved in view of the above-described circumstances, and an object of the present invention is to provide a dielectric filter having desired pass band characteristics and capable of being reduced in size.

According to the present invention, there is provided a dielectric filter comprising a dielectric block generally in the form of a rectangular parallelepiped, an outer conductor covering side surfaces of the dielectric block, a plurality of inner conductors arranged in a row in the longitudinal direction of the dielectric block so that their axes extend parallel to each other from an upper face of the dielectric block to a lower face of same, and a short-circuit conductor provided in the lower face of the dielectric block to connect the outer and inner conductors, the dielectric filter being characterized in that at least one of the plurality of inner conductors has a rectangular cross-sectional shape, and the size of this cross-sectional shape in the longitudinal direction of the dielectric block is smaller at the upper face and larger at the lower face.

In this arrangement, the distance between one inner conductor having a rectangular sectional shape and another adjacent inner conductor is increased on the upper face side of the dielectric block so that odd mode coupling between the conductors is weakened. It is therefore possible to freely set the distance between the outer conductor and two side surfaces of the inner conductor having the rectangular sectional shape. A large fringing (edge) capacitance exists between the outer conductor and angular portions of the inner conductors corresponding to the ends of the two side surfaces. Consequently, the capacitance between the inner and outer conductors per unit length in the axial direction can be increased in comparison of the arrangement in which the sectional shape of the inner conductors is circular, and the overall size of the dielectric filter can therefore be reduced even if a large capacitance value is required.

BRIEF DESCRIPTION OF THE DRAWINGS

FIG. 1(*a*) is a perspective view of the embodiment;

FIG. 1(*b*) is a cross-sectional view taken along the line A—A' of FIG. 1(*a*);

FIG. 1(*c*) is a cross-sectional view taken along the line B—B' of FIG. 1(*a*);

FIG. 2(*a*) is a perspective view;

FIG. 2(*b*) is a cross-sectional view taken along the line A—A' of FIG. 2(*a*);

FIG. 2(*c*) is a cross-sectional view taken along the line B—B' of FIG. 2(*a*);

FIG. 3(*a*) is a perspective view;

FIG. 3(*b*) is a cross-sectional view taken along the line A—A' of FIG. 3(*a*); and FIG. 3(*c*) is a cross-sectional view taken along the line B—B' of FIG. 3(*a*).

DESCRIPTION OF THE PREFERRED EMBODIMENT

An embodiment of the present invention will be described below with reference to the accompanying drawings.

Figure 1A:
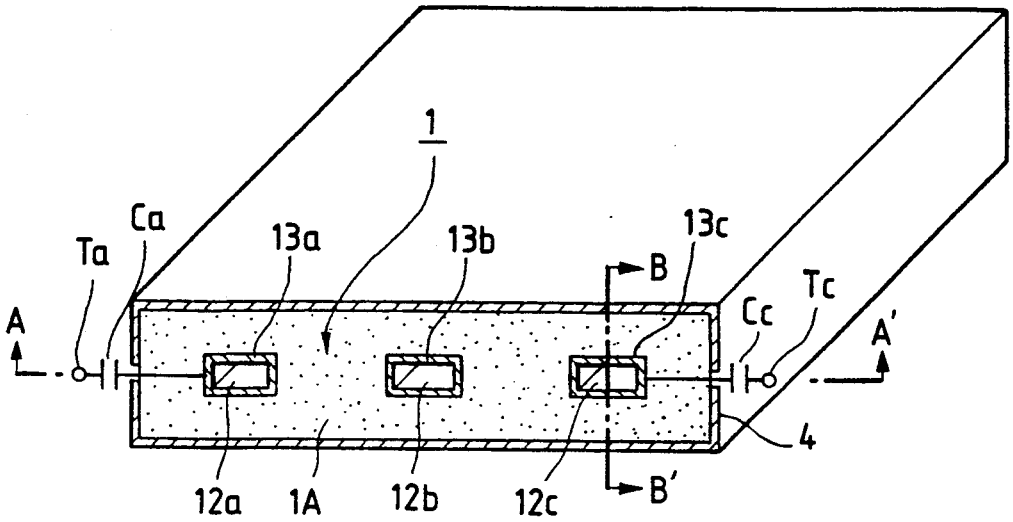
FIGS. 1(*a*) to 1(*c*) show the construction of a dielectric filter in accordance with an embodiment of the present invention.
Figure 1B:
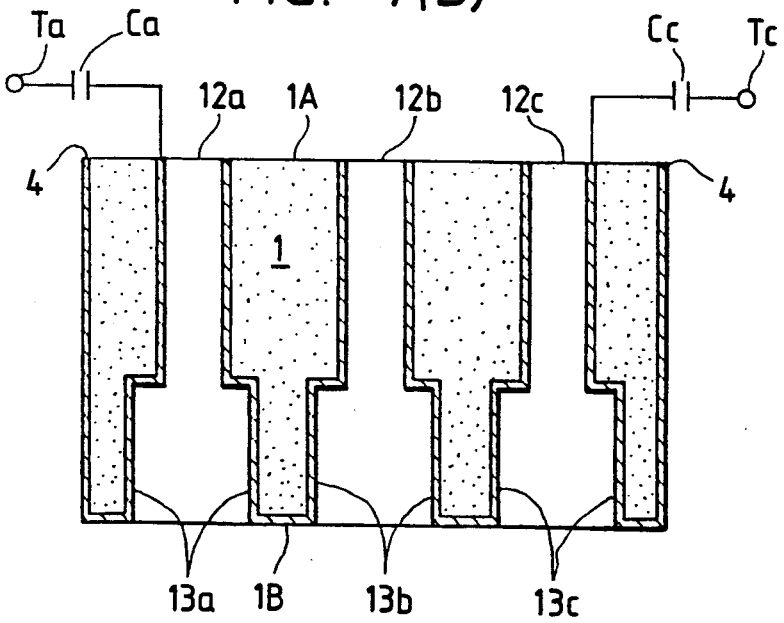
Figure 1C:
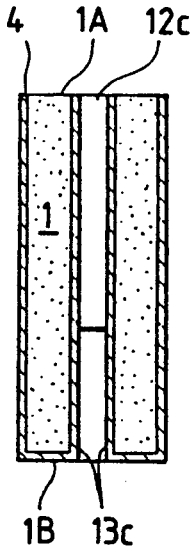
Figure 3A:
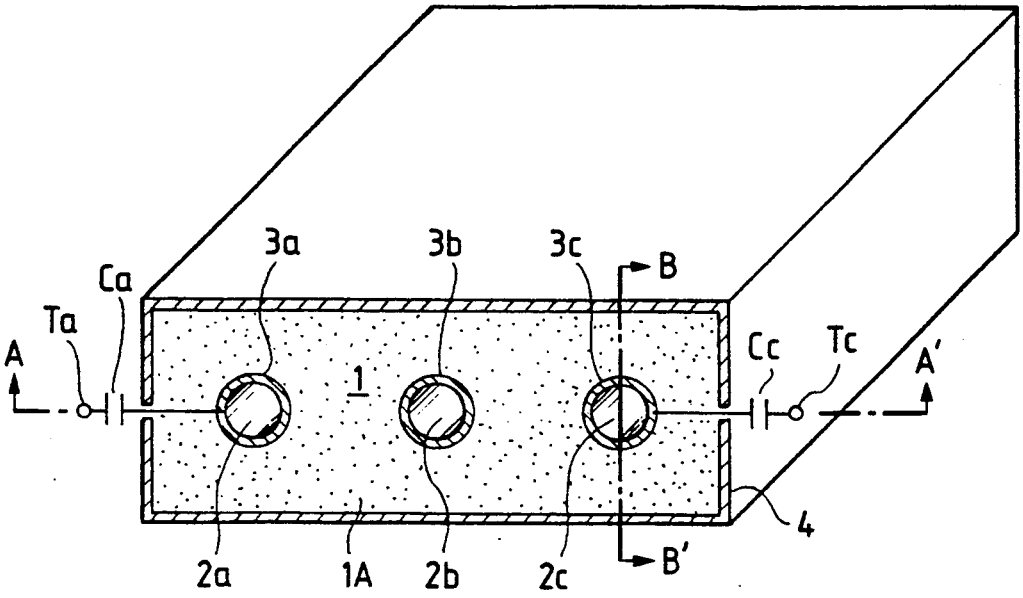
FIG. 3(a) PRIOR ART
FIGS. 3(*a*) to 3(*c*) show the construction of a conventional dielectric filter.
Figure 3B:
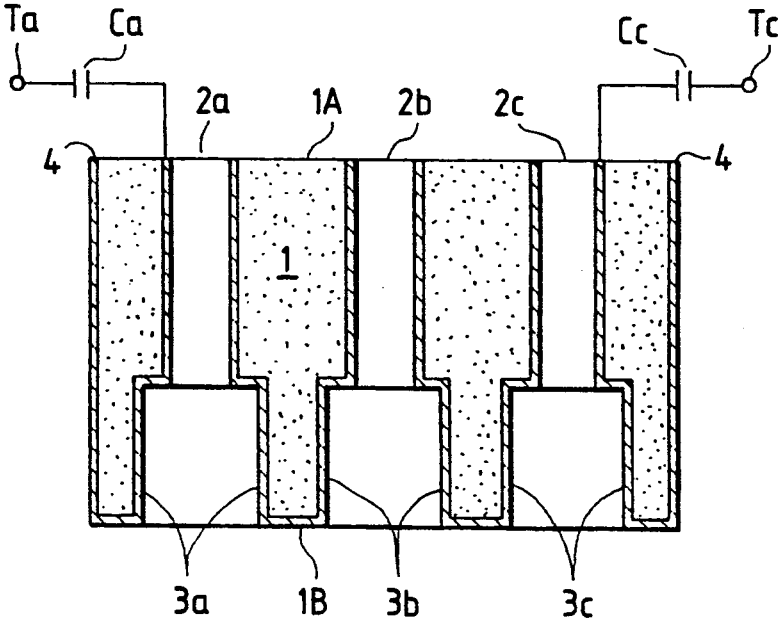
FIG. 3(b) PRIOR ART
Figure 3C:
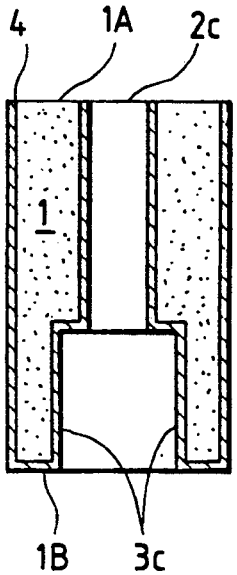
FIG. 3(c) PRIOR ART

Referring to FIGS. 1(*a*) to 1(*c*), a dielectric filter in accordance with the present invention is illustrated. In FIGS. 1(*a*) to 1(*c*), components corresponding to those shown in FIGS. 3(*a*) to 3(*c*) are indicated by the same reference symbols, and the description for them will not be repeated. The dielectric filter of this embodiment differs from the arrangement shown in FIGS. 3(*a*) to 3(*c*) in that through holes 12*a*, 12*b*, and 12*c* having a rectangular cross-sectional shape are formed in a dielectric block 1, with inner conductors 13*a*, 13*b*, and 13*c* formed on inner surfaces of the through holes 12*a*, 12*b*, and 12*c*. The size of the through holes 12*a*, 12*b*, and 12*c* in the longitudinal direction of the dielectric block 1, i.e., the direction of arrangement of the through holes is comparatively reduced on the open end 1A side and is comparatively increased on the short-circuit end 1B side. The size of each hole is constant in the direction perpendicular to the longitudinal direction.

In this arrangement, the distance between adjacent two of the inner conductors 13*a*, 13*b*, and 13*c* is larger on the open end side 1A, so that the odd mode coupling is weakened, and that the inner conductors 13*a*, 13*b*, and 13*c* are in an inductive coupling state. Two side surfaces of the inner conductors 13*a*, 13*b*, and 13*c* face the outer conductor 4, and large fringing capacitances exist between the outer conductor 4 and angular portions of the inner conductors 13*a*, 13*b*, and 13*c*. For this reason, even though the width of the side surfaces of the inner conductors 13*a*, 13*b*, and 13*c* is reduced on the open end 1A side, the capacitances between these conductors and the outer conductor 4 are larger in comparison with the arrangement in which the cross-sectional shape of the inner conductors is circular. Consequently, the axial size of the inner conductors 13*a*, 13*b*, and 13*c* can be reduced so that the dielectric filter has a smaller overall size.

It is not always necessary to make the cross-sectional shape of all the inner conductors 12*a*, 12*b*, and 12*c* rectangular. Inner conductors having a circular cross-sectional shape may be mixed. In such a case also, the obtained effect is similar to that of the above-described embodiment. With respect to inner conductors having a rectangular cross-sectional shape, it is not always necessary to change the sectional shape in the longitudinal direction, i.e., the direction of arrangement of the through holes in a stepping manner as shown in FIG. 1(*b*). The width of the sectional shape in this direction may be gradually reduced from the short-circuit end toward the open end in a tapering manner. Also, the sectional shape may be changed in a stepping or tapering manner in a direction perpendicular to the direction of arrangement of the through holes.

Figure 2A:
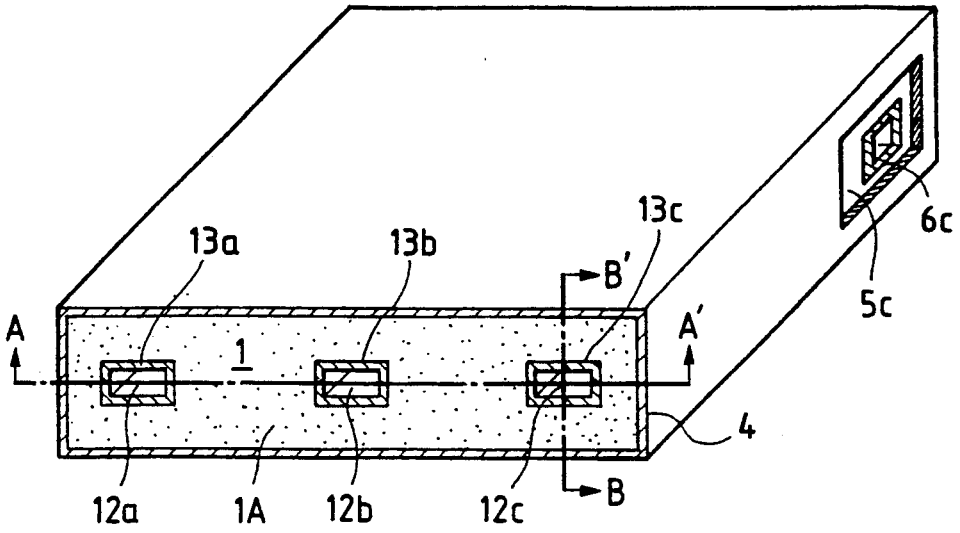
FIGS. 2(*a*) to 2(*c*) show the construction of another dielectric filter provided by applying a tapped line type input/output structure to the embodiment shown in FIGS. 1(*a*) to 1(*c*)
Figure 2B:
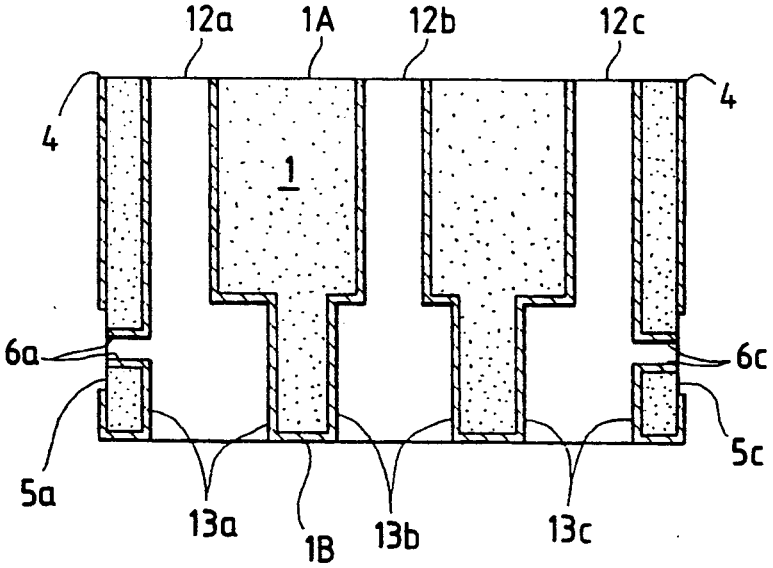
Figure 2C:
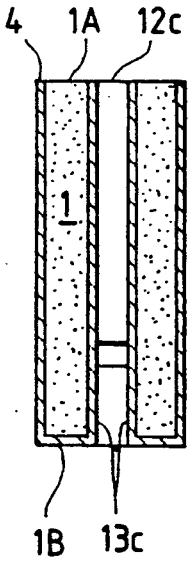

FIGS. 2(*a*) to 2(*c*) show the construction of another dielectric filter provided by applying a tapped line type input/output structure to the above-described embodiment. In this dielectric filter, regions 5*a* and 5*c* of two side surfaces of the dielectric block 1 are not covered with the outer conductor 4, connection holes 6*a* and 6*c* are respectively formed through the dielectric body 1 for communication between the regions 5*a* and 5*c* and the through holes 12*a* and 12*c*, and connection conductors 6*a*, and 6*c* connected to the inner conductors 13*a* and 13*c* are formed on inner surfaces of the connection holes 6*a* and 6*c*. A signal which is to be input into this dielectric filter is applied to the connection conductor 6*a*, and an output signal is extracted through the connection conductor 6*c*. This construction enables input and output parts to be mounted easily.

According to the present invention, as described above, the capacitance between the inner and outer conductors per unit length in the axial direction can be increased and the overall size of the dielectric filter can therefore be reduced.

What is claimed is:

1. A dielectric filter comprising a dielectric block generally in the form of a rectangular parallelepiped, an outer conductor covering outside surfaces of said dielectric block, a plurality of inner conductors arranged in a row in a longitudinal direction of said dielectric block so that their axes extend parallel to each other from an upper face of said dielectric block to a lower face of said dielectric block, and a short-circuit conductor provided in the lower face of said dielectric block to connect said outer and inner conductors, said dielectric filter being characterized in that:

at least one of said plurality of inner conductors has a rectangular cross-sectional shape, and the size of said cross-sectional shape in the longitudinal direction of said dielectric block is smaller at said upper face than at said lower face.

2. A dielectric filter as in claim 1 wherein said at least one inner conductor with a rectangular cross-sectional shape is reduced in cross-sectional area in a tapered fashion from said lower face to said upper face.

3. A dielectric filter as in claim 1 wherein said at least one inner conductor with a rectangular cross-sectional shape is reduced in cross-sectional area in a stepped fashion from said lower face to said upper face.

4. A dielectric filter as in claim 1 wherein the distance between sides of the at least one inner conductor facing the outer conductor and the outer conductor remains constant while the distance between sides of the at least one inner conductor facing other inner conductors and those inner conductors is increased.

5. A dielectric filter as in claim 1 wherein all inner conductors have a rectangular cross-sectional shape.

6. A dielectric filter as in claim 4 wherein all inner conductors have a rectangular cross-sectional shape.

7. A dielectric filter as in claim 1 further characterized in that:

said filter includes a first hole which extends through a side of said dielectric filter between said upper and lower faces to a first inner conductor at an axial location having the same cross-sectional area as that at the lower face, said first inner conductor extending through said first hole to the exterior of said dielectric filter, said outer conductor removed from the outside of said dielectric filter in the region of said first hole so that said first inner conductor does not contact said outer conductor; and said filter includes a second hole which extends through a side of said dielectric filter opposite the side containing said first hole to a second inner conductor at an axial location having the same cross-sectional area as that at the lower face, said second inner conductor extending through said second hole to the exterior of said dielectric filter, said outer conductor removed from the outside of said dielectric filter in the region of said second hole so that said second inner conductor does not contact said outer conductor.

* * * * *